US009805673B2

(12) United States Patent
Shin et al.

(10) Patent No.: US 9,805,673 B2
(45) Date of Patent: Oct. 31, 2017

(54) METHOD OF DRIVING A DISPLAY PANEL AND DISPLAY DEVICE PERFORMING THE SAME

(71) Applicant: Samsung Display Co., Ltd., Yongin, Gyeonggi-Do (KR)

(72) Inventors: Dong-Hwa Shin, Yongin-si (KR); Joon-Chul Goh, Hwaseong-si (KR); Won-Sik Oh, Seoul (KR); Hyun-Sik Hwang, Hwaseong-si (KR); Bong-Hyun You, Yongin-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 31 days.

(21) Appl. No.: 14/161,577

(22) Filed: Jan. 22, 2014

(65) Prior Publication Data

US 2015/0029170 A1 Jan. 29, 2015

(30) Foreign Application Priority Data

Jul. 25, 2013 (KR) ..... 10-2013-0087807

(51) Int. Cl.
*G09G 3/36* (2006.01)

(52) U.S. Cl.
CPC ... *G09G 3/3648* (2013.01); *G09G 2300/0814* (2013.01)

(58) Field of Classification Search
CPC ..... G09G 3/30; G09G 2300/0434; G09G 2300/0439; G09G 2300/0443; G09G 2300/0447; G09G 2300/0452; G09G 2300/0456; G09G 2300/046; G09G 2300/0465; G09G 2300/0469; G09G 2300/0473; G09G 2300/0478; G09G 2300/0482; G09G 2300/0486; G09G 2300/0426; G09G 2300/043; G09G 2310/0264; G09G 2310/027; G09G 2310/0272; G09G 2330/02;
(Continued)

(56) References Cited

U.S. PATENT DOCUMENTS 5,436,635 A * 7/1995 Takahara ..... G09G 3/3648 345/90
5,506,598 A * 4/1996 Shimada ..... G02F 1/13624 345/92

(Continued)

FOREIGN PATENT DOCUMENTS

KR 10-0806889 B1 2/2008
KR 10-2008-0089988 A 10/2008

(Continued)

*Primary Examiner* — Grant Sitta
(74) *Attorney, Agent, or Firm* — Knobbe Martens Olson & Bear LLP

(57) ABSTRACT

A method of driving a display panel is disclosed. In one aspect, the display panel includes a plurality of pixels, each of the pixels including a first transistor connected to a first gate line and a pixel electrode and a second transistor connected to a second gate line and the pixel electrode. The method including alternately providing the first gate line with a gate signal and a reverse bias signal and alternately providing the second gate line with the gate signal when the first gate line is provided with the reverse bias signal and the reverse bias signal when the first gate line is provided with the gate signal.

15 Claims, 8 Drawing Sheets

(58) Field of Classification Search
CPC ..... G09G 2330/022; G09G 2330/023; G09G 2330/024; G09G 2310/063; G09G 2330/00; G09G 2330/025; G09G 2330/028; G09G 3/3648; G09G 2310/0275; G09G 2310/0278; G09G 2320/00; G09G 2320/02; G09G 2320/0204; G09G 2320/0228; G09G 2320/0233; G09G 23/0421; G09G 2330/021; G09G 1/005; G09G 2310/0245; G09G 2330/026; G09G 2330/027
USPC ..... 345/204, 76–87
See application file for complete search history.

(56) References Cited

U.S. PATENT DOCUMENTS 6,266,038 B1 * 7/2001 Yoshida ..... G09G 3/3659 345/100
6,552,707 B1 * 4/2003 Fujiyoshi ..... G09G 3/3648 345/100
6,566,643 B2 * 5/2003 Morita ..... G09G 3/3688 250/208.1
7,847,796 B2 * 12/2010 Shin ..... G09G 3/3266 345/210
8,269,704 B2 9/2012 Jung et al.
8,330,700 B2 12/2012 Yamanaka et al.
9,024,978 B2 * 5/2015 Sehata ..... G09G 3/2007 345/204
2003/0146890 A1 * 8/2003 Sasaki ..... 345/87
2005/0231455 A1 * 10/2005 Moon ..... G09G 3/3648 345/89
2006/0109227 A1 * 5/2006 Park ..... 345/98
2007/0097052 A1 5/2007 Sasaki
2008/0007547 A1 * 1/2008 Hasumi et al. ..... 345/211
2008/0136765 A1 * 6/2008 Neugebauer ..... G02F 1/13624 345/98
2008/0142827 A1 * 6/2008 Choi ..... G09G 3/3233 257/98
2009/0027312 A1 * 1/2009 Han ..... G09G 3/3233 345/76
2009/0243978 A1 * 10/2009 Yamamoto ..... G09G 3/3233 345/76
2009/0267871 A1 * 10/2009 Tanabe ..... G02F 1/13624 345/55
2010/0001934 A1 * 1/2010 Leo ..... G09G 3/3659 345/87
2011/0175882 A1 * 7/2011 Stryakhilev ..... G09G 3/3233 345/211

FOREIGN PATENT DOCUMENTS

KR 10-2009-0073465 A 7/2009
KR 10-2011-0063045 A 6/2011
KR 10-2012-0074716 A 7/2012

* cited by examiner

METHOD OF DRIVING A DISPLAY PANEL AND DISPLAY DEVICE PERFORMING THE SAME

This application claims priority from and the benefit of Korean Patent Application No. 10-2013-0087807 filed on Jul. 25, 2013, which is hereby incorporated by reference for all purposes as if fully set forth herein.

BACKGROUND

Field

The described technology generally relates to a method of driving a display panel and a display device for performing the method, and more particularly, to a method of driving a display panel capable of improving the display quality thereof.

Description of the Related Technology

Generally, liquid crystal displays (LCDs) are relatively thin, light weight and have low power consumption, and thus LCDs are used in monitors, laptop computers and cellular phones, etc. LCDs generally include an LCD panel displaying images using the light transmittance of a liquid crystal layer, a backlight assembly disposed under the LCD panel and providing light to the LCD panel and a driving circuit driving the LCD panel.

The liquid display panel can include an array substrate which has a gate line, a data line, a thin film transistor and a pixel electrode. The liquid crystal display panel can also include an opposing substrate which has a common electrode and a liquid crystal layer interposed between the array substrate and the opposing substrate. The driving circuit typically includes a gate driver which drives the gate line and a data driver which drives the data line.

SUMMARY OF CERTAIN INVENTIVE ASPECTS

One inventive aspect is a method of driving a display panel capable of substantially preventing the degradation of a transistor.

Another aspect is a display device performing the method of driving the display panel.

Another aspect is a method of driving a display panel including a plurality of pixels, each of the pixels comprising a first transistor connected to a first gate line and a pixel electrode and a second transistor connected to a second gate line and the pixel electrode. The method includes alternately providing the first gate line with a gate signal and a reverse bias signal and alternately providing the second gate line with the gate signal when the first gate line is provided with the reverse bias signal and the reverse bias signal when the first gate line is provided with the gate signal.

One of the first and second transistors may transfer a data signal to the pixel electrode in response to the gate signal, and the other of the first and second transistors may be annealed by the reverse bias signal.

The gate signal may include an ON voltage and an OFF voltage, and the reverse bias signal may be different from the OFF voltage.

The gate signal may include an ON voltage and an OFF voltage, and the reverse bias signal may be substantially equal to the OFF voltage.

Another aspect is a method of driving a display panel including a plurality of pixels, each of the pixels comprising a first transistor connected to a first gate line and a pixel electrode and a second transistor connected to a second gate line and the pixel electrode. The method includes providing the first gate line with a gate signal to transfer a data signal to the pixel electrode through the first transistor during a first predetermined period and providing the second gate line with a reverse bias signal to anneal the second transistor during the first predetermined period.

The method may further include providing the first gate line with the reverse bias signal to anneal the first transistor during a second predetermined period and providing the second gate line with the gate signal to transfer the data signal to the pixel electrode through the second transistor during the second predetermined period.

The gate signal may include an ON voltage and a first OFF voltage and the reverse bias signal has a second OFF voltage different from the first OFF voltage.

The first OFF voltage may be a maximum voltage from a range of allowable voltages capable of turning off the first and second transistors and the second OFF voltage may be a minimum voltage from the range of the allowable voltages.

The gate signal may include an ON voltage and an OFF voltage and the reverse bias signal may be substantially equal to the OFF voltage.

The first predetermined period may be about one hour.

Another aspect is a display device including a display panel which comprises a plurality of pixels, each of the pixels comprising a first transistor connected to a first gate line and a pixel electrode and a second transistor connected to a second gate line and the pixel electrode, a first gate driver which is connected to the first gate line and alternately provides the first gate line with a gate signal and a reverse bias signal and a second gate driver which is connected to the second gate line and alternately providing the second gate line with the gate signal when the first gate line is provided with the reverse bias signal and the reverse bias signal when the first gate line is provided with the gate signal.

The first gate driver may provide the first gate line with the gate signal to turn on the first transistor during a first predetermined period, and the second gate driver may provide the second gate line with the gate signal to anneal the second transistor during the first predetermined period.

The first gate driver may provide the first gate line with the reverse bias signal to anneal the first transistor during a second predetermined period and the second gate driver may provide the second gate line with the gate signal to turn on the second transistor during the second predetermined period.

The first predetermined period may be substantially equal to the second predetermined period.

Each of the first and second predetermined periods may be about one hour.

The gate signal may include an ON voltage and a first OFF voltage and the reverse bias signal may have a second OFF voltage different from the first OFF voltage.

The first OFF voltage may be a maximum voltage from a range of allowable voltages capable of turning off the first and second transistors and the second OFF voltage may be a minimum voltage from the range of the allowable voltages.

The gate signal may include an ON voltage and an OFF voltage and the reverse bias signal may be substantially equal to the OFF voltage.

The gate signal may be sequentially applied to a plurality of gate lines, and the reverse bias signal may be concurrently applied to a plurality of gate lines.

The first and second transistors may be connected to the same data line.

According to at least one embodiment, the odd-numbered gate lines alternately receive the gate signal and the reverse bias signal, and the even-numbered gate lines alternately receives the reverse bias signal and the gate signal out of phase with the odd-numbered gate lines. Therefore, the first transistor which is connected to one of the odd-numbered gate lines and the second transistor which is connected to one of the even-numbered gate lines are alternately annealed by the reverse bias signal so that the first and second transistors may be substantially prevented from being degraded when driven for extended periods. Therefore, the charging ratio of the liquid crystal capacitor may be improved so that the display quality may be improved.

BRIEF DESCRIPTION OF THE DRAWINGS

The above and other features and advantages of the described technology will become more apparent by describing in detailed exemplary embodiments thereof with reference to the accompanying drawings.

DETAILED DESCRIPTION OF CERTAIN INVENTIVE EMBODIMENTS

The thin film transistors which drive the pixel electrodes can degrade due to continuous driving over an extended period so that the threshold voltage of the thin film transistors shift in a positive direction. By shifting the threshold voltage, the turn-on current of the thin film transistors can decrease so that the charging ratio of the LCD panel can also decrease. Therefore, blackening can occur in an image displayed on a display device due to the decrease in charging ratio.

Throughout this specification and the claims that follow, when it is described that an element is "connected" to another element, the element may be "directly connected" to the other element or connected to the other element through a third element. The term "connected" as used herein respectively includes the term "electrically connected."

Hereinafter, the described technology will be explained in detail with reference to the accompanying drawings.

Figure 1:
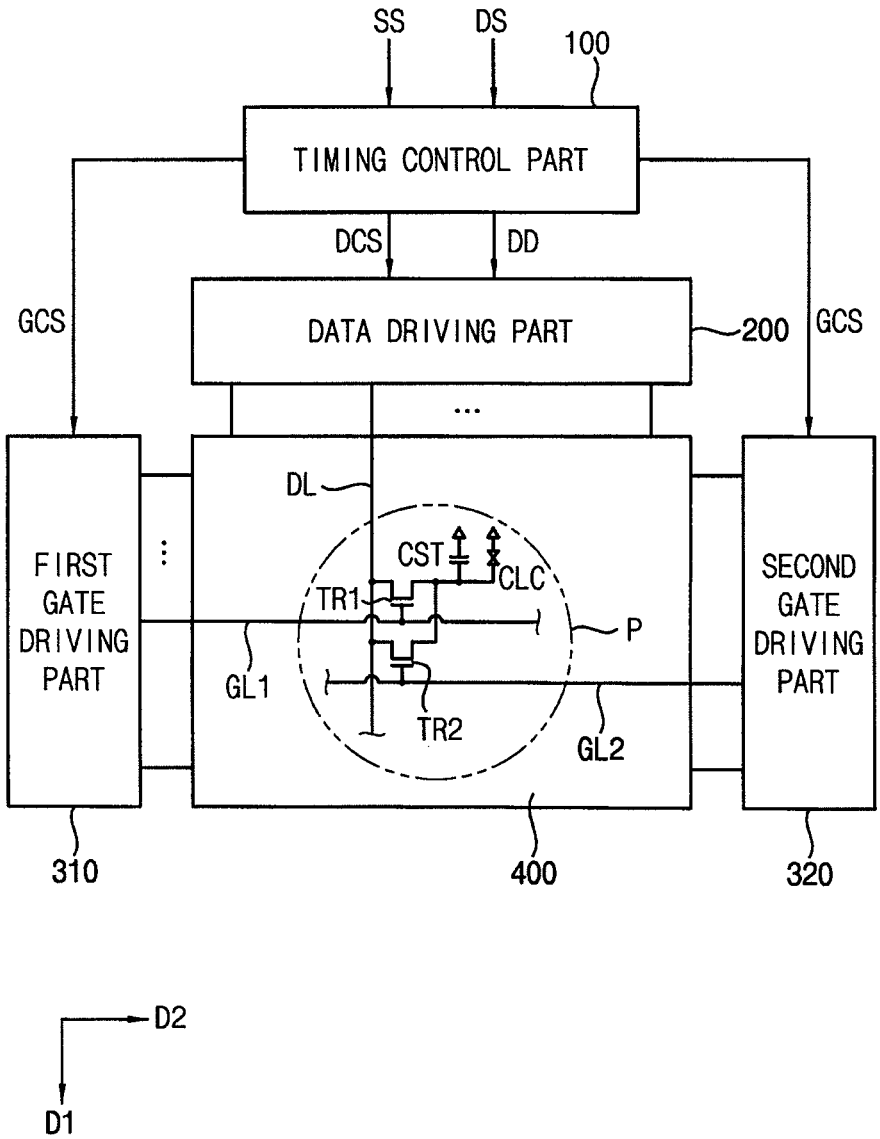
FIG. 1 is a plan view illustrating a display device according to an exemplary embodiment.

FIG. 1 is a plan view illustrating a display device according to an exemplary embodiment.

Referring to FIG. 1, the display device may include a timing control part (or timing controller) 100, a data driving part (or data driver) 200, a first gate driving part (or first gate driver) 310, a second gate driving part (or second gate driver) 320 and a display panel 400.

The timing control part 100 generates a data control signal DCS and a gate control signal GCS using a synchronization signal SS to drive the data driving part 200 and the first and second gate driving parts 310 and 320. The timing control part 100 corrects image data using a compensation algorithm to provide the data driving part 200 with correction data DD.

The timing control part 100 alternately drives the first and second gate driving parts 310 and 320 in a scanning mode and an annealing mode during predetermined periods. The annealing mode means a non-operating mode where one of driving transistors (TR1, TR2) is turned off or otherwise inactive.

The data driving part 200 converts the correction data DD, which is digital data, into a data voltage using a reference gamma voltage and outputs the data voltage to the display panel 400.

The first gate driving part 310 is alternately operated in the scanning mode which sequentially outputs a plurality of gate signals and in the annealing mode which concurrently outputs a plurality of reverse bias signals, based on the gate control signal GCS received from the timing control part 100. The gate signal includes an ON voltage and an OFF voltage. The gate signal includes a pulse which has the ON voltage and is repeated in increments of a frame period.

According to some embodiments, the reverse bias signal is a direct current. The OFF voltage of the gate signal can be the maximum voltage of an allowable voltage range and the reverse bias signal can be the minimum voltage of the allowable voltage range. The transistor driving the pixel of the display panel turns off in the allowable voltage range and the allowable voltage range may be predetermined based on an off-leakage current and a kickback voltage of the driving transistor.

The first gate driving part 310 is electrically connected to odd-numbered gate lines in the display panel 400 and is not connected to the even-numbered gate lines. Thus, the first gate driving part 310 drives the odd-numbered gate lines.

The second gate driving part 320 is electrically connected to the even-numbered gate lines and is not connected to the odd-numbered gate lines. Thus, the second gate driving part 320 drives the even-numbered gate lines.

The second gate driving part 320 is driven in an operation mode out of phase with the operation mode of the first gate driving part 310 based on the gate control signal GCS received from the timing control part 100. For example, when the first gate driving part 310 is operated in the scanning mode which sequentially outputs the gate signals, the second gate driving part 320 is operated in the annealing mode which concurrently outputs the reverse bias signals. Further, when the first gate driving part 310 is operated in the annealing mode, the second gate driving part 320 is operated in the scanning mode.

The display panel 400 may include a plurality of data lines DL, a plurality of gate lines GL1 and GL2 and a plurality of pixels P. The data lines DL extend in a first direction 1 and are arranged in a second direction D2 crossing the first direction D1. The gate lines GL1 and GL2 extend in the second direction D2 and are arranged in the first direction D1. The pixels P are arranged in a substantially matrix form and each of the pixels P may includes a first transistor TR1, a second transistor TR2, a liquid crystal capacitor CLC and a storage capacitor CST.

The first transistor TR1 is connected to a data line DL, an odd-numbered gate line GL1 and the liquid crystal capacitor CLC. The second transistor TR2 is connected to the data line DL, an even-numbered gate line GL2 and the liquid crystal capacitor CLC. The storage capacitor CST is connected to the liquid crystal capacitor CLC. The first gate line GL1 is connected to the first gate driving part 310 and is not connected to the second gate driving part 320. The second gate line GL2 is connected to the second gate driving part 320 and is not connected to the first gate driving part 310.

According to an embodiment, when the first transistor TR1 receives a gate signal through the odd-numbered gate line GL1, the second transistor TR2 receives the reverse bias signal through the even-numbered gate line GL2. Additionally, when the first transistor TR1 receives the reverse bias signal through the odd-numbered gate line GL1, the second transistor TR2 receives a gate signal through the even-numbered gate line GL2.

When the first transistor TR1 drives the liquid crystal capacitor CLC, the second transistor TR2 is in an inactive state in which the second transistor TR2 is annealed by the reverse bias signal. Similarly, when the second transistor TR2 drives the liquid crystal capacitor CLC, the first transistor TR1 is in an inactive state in which the first transistor TR1 is annealed by the reverse bias signal.

According to the FIG. 1 embodiment, the first and second transistors TR1 and TR2 are alternately in the annealing mode so that the first and second transistors TR1 and TR2 may be substantially prevented from being degraded by being driven for an extended period of time. Thus, degradation of display quality, for example, blackening, may be substantially prevented. Blackening may occur when the charging rate of the liquid crystal capacitor CLC is reduced.

Figure 2:
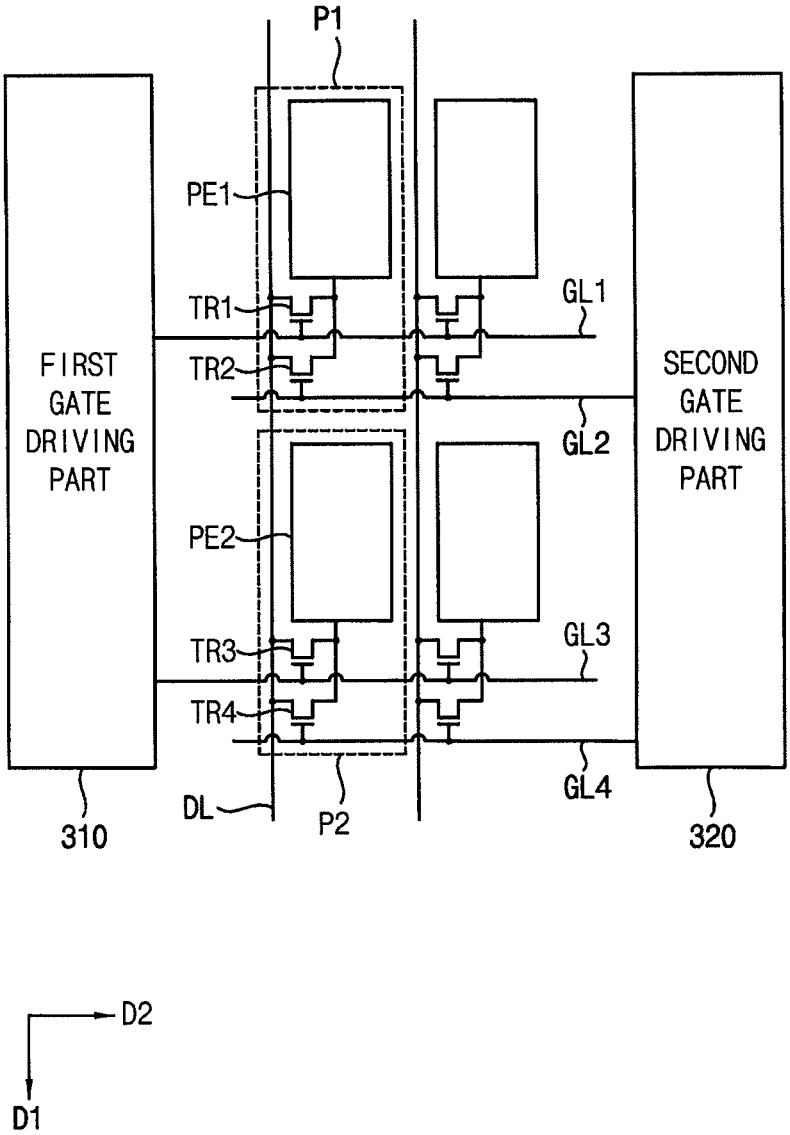
FIG. 2 is a conceptual diagram illustrating a pixel of the display device shown in FIG. 1.

FIG. 2 is a conceptual diagram illustrating a pixel of the display device as shown in FIG. 1.

Referring to FIG. 2, the display panel 400 includes a pixel having a substantially rectangular shape having a longer side and a shorter side. For example, the display panel 400 includes a first pixel P1 and a second pixel P2 with the longer side being arranged in a longitudinal direction D1.

The first pixel P1 includes a first transistor TR1, a second transistor TR2 and a first pixel electrode PE1. The first transistor TR1 is electrically connected to a data line DL, a first gate line GL1 and the first pixel electrode PE1. The first gate line GL1 is connected to the first gate driving part 310 and is not connected to the second gate driving part 320.

The second transistor TR2 is electrically connected to the data line DL, a second gate line GL2, and the first pixel electrode PE. The second gate line GL2 is connected to the second gate driving part 320 and is not connected to the first gate driving part 310. The second gate line GL2 is disposed adjacent to the first gate line GL1.

The second pixel P2 includes a third transistor TR3, a fourth transistor TR4 and a second pixel electrode PE2.

The third transistor TR3 is electrically connected to the data line DL, a third gate line GL3 and the second pixel electrode PE2. The third gate line GL3 is connected to the first gate driving part 310 and is not to the second gate driving part 320. The third gate line GL3 is spaced apart from the second gate line GL2 so that the second pixel electrode PE2 is disposed between the second and third gate lines GL2 and GL3.

The fourth transistor TR4 is electrically connected to the data line DL, a fourth gate line GL4 and the second pixel electrode PE2. The fourth gate line GL4 is connected to the second gate driving part 320 and is not connected to the first gate driving part 310. The fourth gate line GL4 is disposed adjacent to the third gate line GL3.

The first and second gate driving parts 310 and 320 are alternately operated in the scanning mode and the annealing mode so that one of two transistors in each pixel turns-on to drive the pixel electrode and the other of two transistors is annealed by the reverse bias signal.

Figure 3:
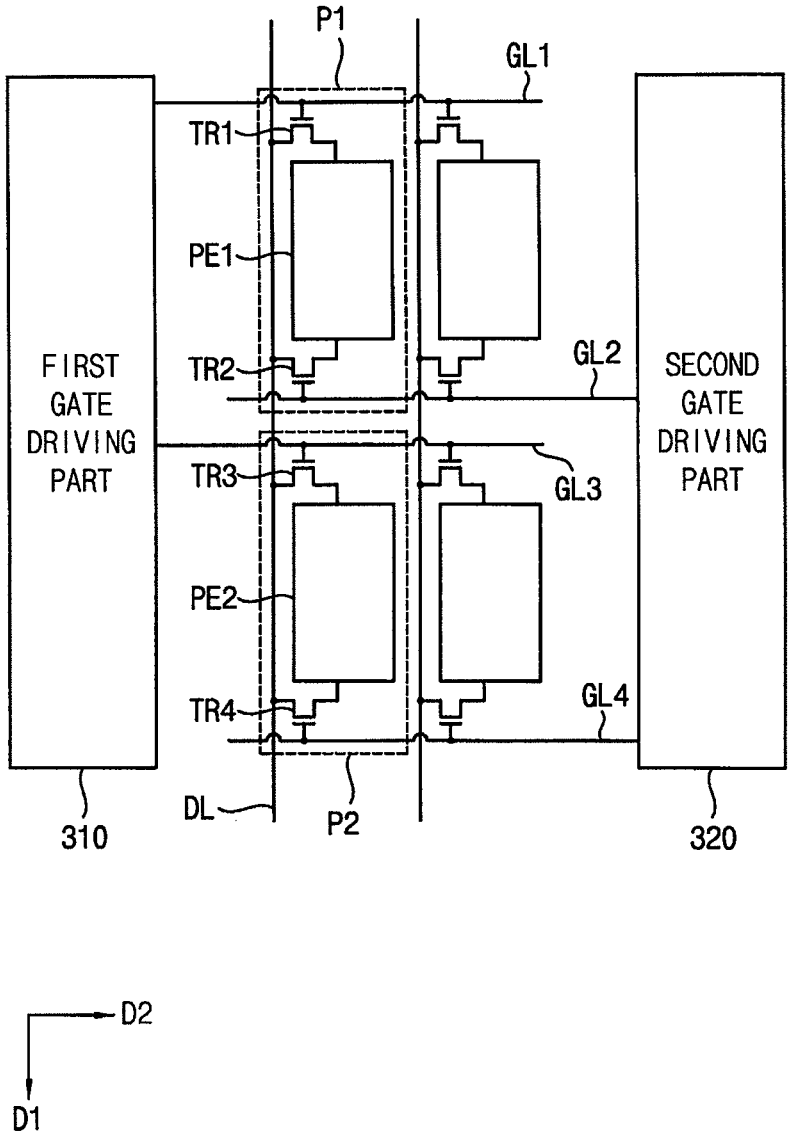
FIG. 3 is a conceptual diagram illustrating a pixel of a display device according to an exemplary embodiment.

FIG. 3 is a conceptual diagram illustrating a pixel of a display device according to another exemplary embodiment.

Referring to FIG. 3, the display panel 400 includes a pixel having a substantially rectangular shape having a longer side and a shorter side. For example, the display panel 400 includes a first pixel P1 and a second pixel P2 which are arranged in a direction D1.

The first pixel P1 includes a first transistor TR1, a second transistor TR2 and a first pixel electrode PE1. The first and second transistors TR1 and TR2 are disposed adjacent to the shorter sides of the first pixel P1.

The first transistor TR1 is electrically connected to a data line DL, a first gate line GL1 and the first pixel electrode PE1. The first gate line GL1 is connected to the first gate driving part 310 and is not connected to the second gate driving part 320.

The second transistor TR2 is electrically connected to the data line DL, a second gate line GL2 and the first pixel electrode PE1. The second gate line GL2 is connected to the second gate driving part 320 and is not connected to the first gate driving part 310.

The second gate line GL2 is spaced apart from the first gate line GL1 so that the first pixel electrode PE1 is disposed between the first and second gate lines GL1 and GL2. Thus, the first pixel electrode PE1 is disposed between the first and second gate lines GL1 and GL2.

The second pixel P2 includes a third transistor TR3, a fourth transistor TR4 and a second pixel electrode PE2. The third transistor TR3 is electrically connected to the data line DL, a third gate line GL3 and the second pixel electrode PE2.

The third gate line GL3 is connected to the first gate driving part 310, and is not connected to the second gate driving part 320. The third gate line GL3 is disposed adjacent to the second gate line GL2.

The fourth transistor TR4 is electrically connected to the data line DL, a fourth gate line GL4 and the second pixel electrode PE2. The fourth gate line GL4 is connected to the second gate driving part 320 and is not connected to the first gate driving part 310.

The fourth gate line GL4 is spaced apart from the third gate line GL3 so that the second pixel electrode PE2 is disposed between the third and fourth gate lines GL3 and GL4. Thus, the second pixel electrode PE2 is disposed between the third and fourth gate lines GL3 and GL4.

Although not shown in the figures, the structure of the pixels may have various different designs and is not limited to the illustrated structures.

Figure 4:
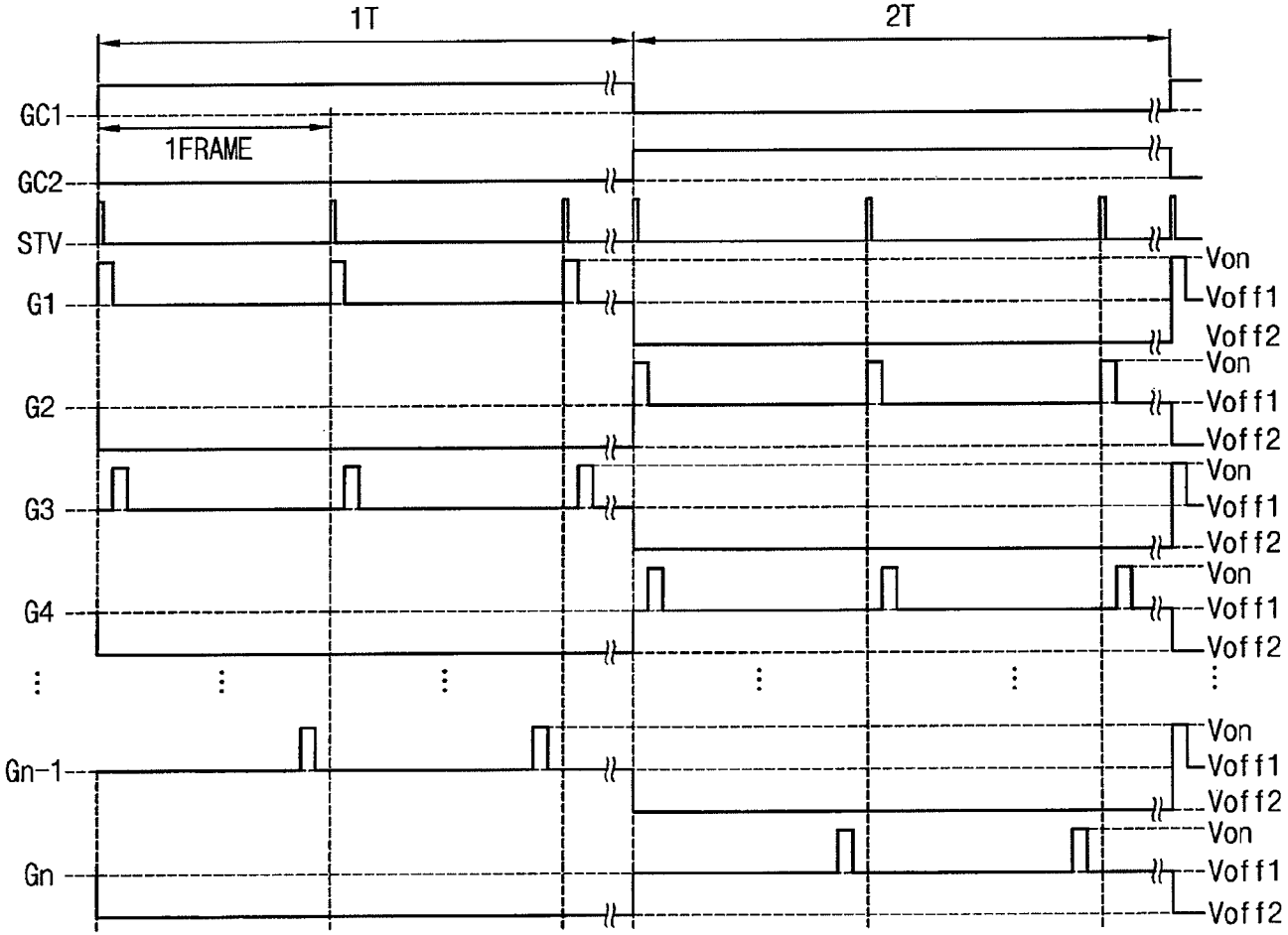
FIG. 4 is a waveform diagram illustrating a method of driving a display device according to an exemplary embodiment.

FIG. 4 is a waveform diagram illustrating a method of driving a display device according to an exemplary embodiment.

Referring to FIGS. 1 and 4, the timing control part 100 respectively provides the first and second gate driving parts 310 and 320 with a gate control signal GCS including a first driving control signal GC1 and a second driving control signal GC2.

According to some embodiments, when the first and second driving control signals GC1 and GC2 have a high level, the first and second gate driving parts 310 and 320 are operated in the scanning mode. When the first and second driving control signals GC1 and GC2 have a low level, the first and second gate driving parts 310 and 320 are operated in the annealing mode.

Each of the first and second driving control signals GC1 and GC2 alternates between the high level and the low level for each predetermined period T. The first and second driving control signals GC1 and GC2 respectively have opposite levels to each other during each predetermined period T. The length of the predetermined period T may be predetermined according to the design requirements. The predetermined period T may be preset as an hour. For example, the predetermined period T may be about one hour.

During a first predetermined period 1T, the first gate driving part 310 is operated in the scanning mode in response to the first driving control signal GC1 having the high level and the second gate driving part 320 is operated in the annealing mode in response to the second driving control signal GC2 having the low level.

When in the scanning mode, the first gate driving part 310 sequentially provides odd-numbered gate lines with gate signals G1, G3, . . . , Gn−1. When in the annealing mode, the second gate driving part 320 concurrently provides even-numbered gate lines with reverse bias signals G2, G4, . . . , Gn.

As shown in FIG. 4, each of the odd gate signals G1, G3, . . , Gn−1 has a pulse having an ON voltage Von and a first OFF voltage Voff1 which are alternately repeated for each frame period. The reverse bias signal is a direct current signal which has a second OFF voltage Voff2 less than the first OFF voltage Voff1. The first OFF voltage Voff1 is the maximum voltage of an allowable voltage range and the second OFF voltage Voff2 is the minimum voltage of the allowable voltage range. The first or second transistor turns off in the allowable voltage range and the allowable voltage range may be preset based on an off-leakage current and a kickback voltage of the driving transistors.

Therefore, during a first predetermined period 1T, the first transistor TR1 of the pixel P receives the gate signal and turns on in response to the gate signal. Thus, the liquid crystal capacitor CLC charges to a data signal transferred through the turned-on first transistor TR1. In addition, the second transistor TR2 of the pixel P receives the reverse bias signal. Thus, the second transistor TR2 is annealed by the reverse bias signal.

Then, during a second predetermined period 2T, the first gate driving part 310 is operated in the annealing mode in response to the first driving control signal GC1 having the low level and the second gate driving part 320 is operated in the scanning mode in response to the second driving control signal GC2 having the high level.

When in the annealing mode, the first gate driving part 310 concurrently provides the odd-numbered gate lines with the reverse bias signals G1, G3, . . . , Gn−1 having the second OFF voltage Voff2. When in the scanning mode, the second gate driving part 320 sequentially provides the even-numbered gate lines with the gate signals G2, G4, . . . , Gn having the ON voltage Von and the first OFF voltage Voff1.

Therefore, during the second predetermined period 2T, the second transistor TR2 of the pixel P receives the gate signal and turns on in response to the gate signal. Thus, the liquid crystal capacitor CLC charges to a data signal transferred through the turned-on second transistor TR2. In addition, the first transistor TR1 of the pixel P receives the reverse bias signal. Thus, the first transistor TR1 is annealed by the reverse bias signal.

As described above, during the first predetermined period 1T, the second transistor TR2 electrically connected to the second gate driving part 320 is annealed by the reverse bias signal and thus, the second transistor TR2 is in an inactive state. During the second predetermined period 2T, the first transistor TR1 electrically connected to the first gate driving part 310 is annealed by the reverse bias signal and thus, the first transistor TR1 is in the inactive state. Therefore, the first and second transistors TR1 and TR2 of the pixel P which drive the liquid crystal capacitor CLC, are alternately annealed during the predetermined periods and thus, the first and second transistors TR1 and TR2 may be substantially prevented from being degraded when being driven for extended periods.

Figure 5:
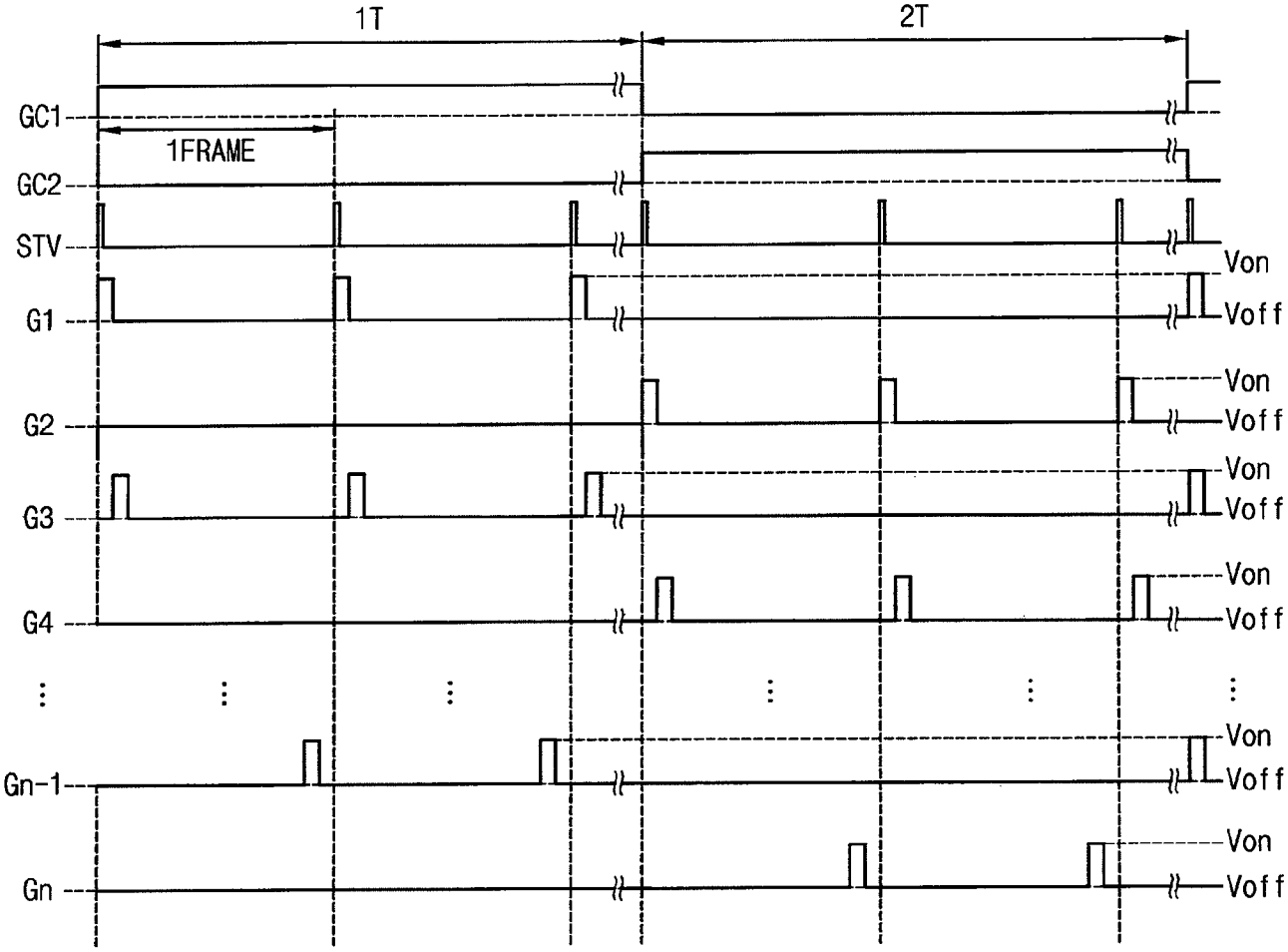
FIG. 5 is a waveform diagram illustrating a method of driving a display according to an exemplary embodiment.

FIG. 5 is a waveform diagram illustrating a method of driving a display according to an exemplary embodiment.

Referring to FIGS. 1 and 5, the timing control part 100 respectively provides the first and second gate driving parts 310 and 320 with a first driving control signal GC1 and a second driving control signal GC2 that are included in a gate control signal GCS.

During a first predetermined period 1T, the first gate driving part 310 is operated in the scanning mode in response to the first driving control signal GC1 having a high level and the second gate driving part 320 is operated in the annealing mode in response to the second driving control signal GC2 having a low level.

When in the scanning mode, the first gate driving part 310 sequentially provides odd-numbered gate lines with gate signals G1, G3, . . . , Gn−1 having the alternately repeated ON and OFF voltages by for each frame period. When in the annealing mode, the second gate driving part 320 concurrently provides even-numbered gate lines with reverse bias signals G2, G4, . . . , Gn which have a predetermined voltage.

According to the exemplary embodiment, the reverse bias signal may have the OFF voltage Voff.

Therefore, during a first predetermined period 1T, the first transistor TR1 of the pixel P receives the gate signal and turns on in response to the gate signal. Thus, the liquid crystal capacitor CLC charges to a data signal transferred through the turned-on first transistor TR1. In addition, the second transistor TR2 of the pixel P receives the reverse bias signal. Thus, the second transistor TR2 is annealed by the reverse bias signal.

Then, during a second predetermined period 2T, the first gate driving part 310 is operated in the annealing mode in response to the first driving control signal GC1 having the low level and the second gate driving part 320 is operated in the scanning mode in response to the second driving control signal GC2 having the high level.

When in the annealing mode, the first gate driving part 310 concurrently provides the odd-numbered gate lines with the reverse bias signals G1, G3, . . . , Gn−1 having the OFF voltage Voff. When in the scanning mode, the second gate driving part 320 sequentially provides the even-numbered gate lines with the gate signals G2, G4, . . . , Gn having the ON voltage Von and the OFF voltage Voff.

Therefore, during the second predetermined period 2T, the second transistor TR2 of the pixel P receives the gate signal and turns on in response to the gate signal. Thus, the liquid crystal capacitor CLC charges to a data signal transferred through the turned-on second transistor TR2. In addition, the first transistor TR1 of the pixel P receives the reverse bias signal. Thus, the first transistor TR1 is annealed by the reverse bias signal.

Therefore, the first and second transistors TR1 and TR2 of the pixel P which drive the liquid crystal capacitor CLC are alternately annealed during the predetermined period, and thus, the first and second transistors TR1 and TR2 may be substantially prevented from being degraded by being driven for extended periods.

FIGS. 6A to 6D are conceptual diagrams illustrating a method of reducing blackening according to an exemplary embodiment.

Figure 6A:
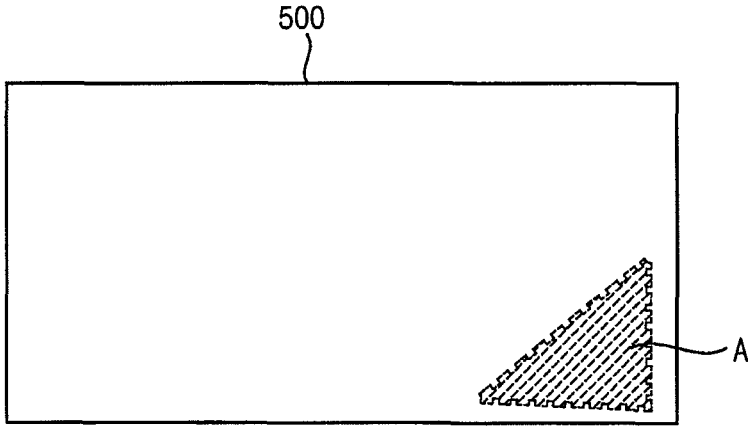
FIGS. 6A to 6D are conceptual diagrams illustrating a method of improving blackening according to an exemplary embodiment.

Referring to FIG. 6A, the display panel 500 includes an area A in which blackening occurs due to driving the display panel 500 for an extended period. According to the exemplary embodiment, a reverse bias signal of about −20 V was applied to a display panel 500 for about 100 hours so that negative annealing was performed. Thereafter, the area A was observed to include blackening.

Figure 6B:
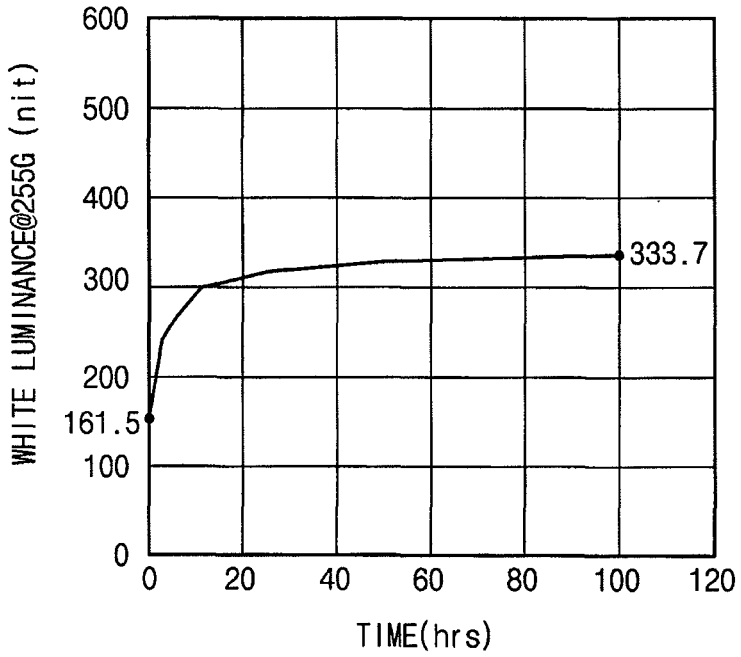

Referring to FIG. 6B, when a 255-grayscale image was displayed on the display panel 500, the luminance of the area A before the negative annealing was about 161.5 nit and the luminance of the area A after the negative annealing was about 333.7 nit. Thus, the luminance of the area A was increased by about 172.2 nit (106.7%) so that the blackening of the area A was reduced.

Figure 6C:
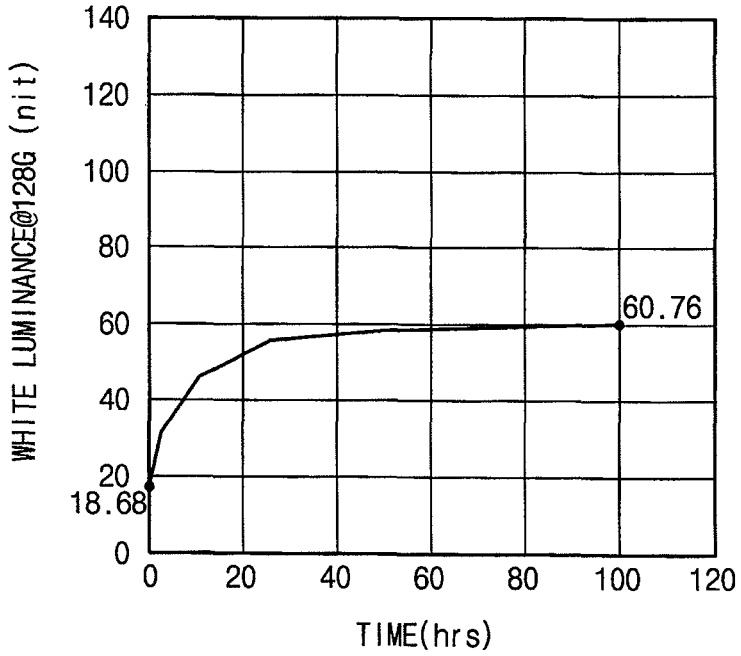

Referring to FIG. 6C, when a 238-grayscale image was displayed in the display panel 500, the luminance of the area A before the negative annealing was about 18.68 nit and the luminance of the area A after the negative annealing was about 60.7 nit. Thus, the luminance of the area A was increased by about 42 nit (225%) so that the blackening of the area A was reduced.

Figure 6D:
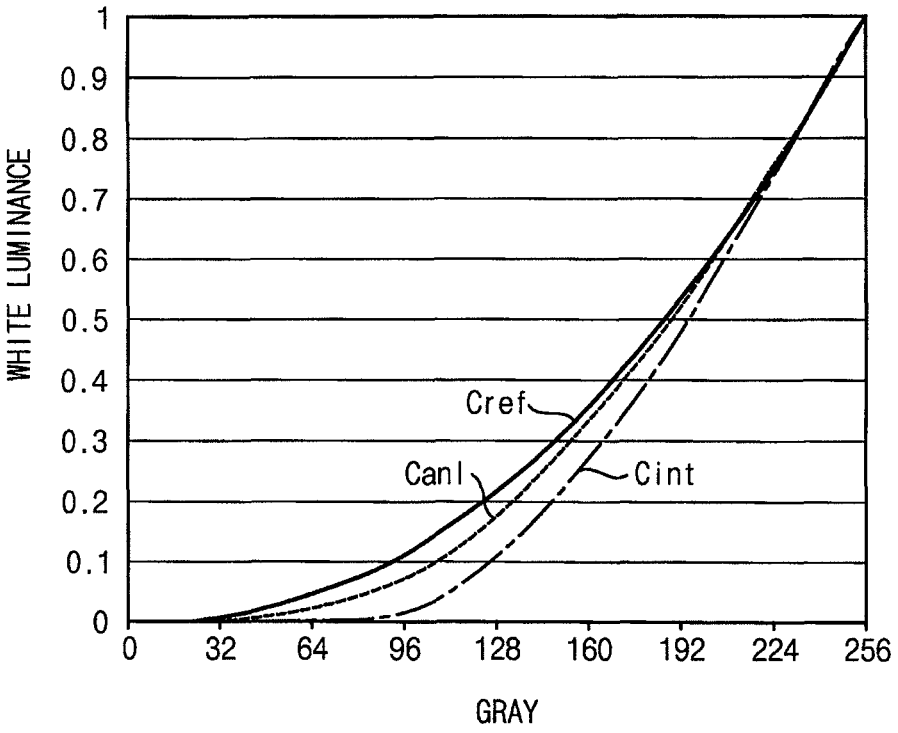

Referring to FIG. 6D, the gamma curve of the display panel 500 before the negative annealing was an about 3.13-gamma curve Cint. The gamma curve of the display panel 500 after the negative annealing was an about 2.47-gamma curve Canl. The gamma curve after the negative annealing is adjacent to an about 2.2-gamma curve Cref of a reference gamma curve.

As described above, the degradation of a transistor which is driven for an extended period of time may be improved through the negative annealing.

According to at least one of the disclosed embodiments, the odd-numbered gate lines alternately receive the gate signal and the reverse bias signal, and the even-numbered gate lines alternately receive the reverse bias signal and the gate signal out of phase with the odd-numbered gate lines. Therefore, the first transistor which is connected to an odd-numbered gate line and the second transistor which is connected to an even-numbered gate line are alternately annealed by the reverse bias signal so that the first and second transistors may be substantially prevented from being degraded when being driven for extended periods. Therefore, the charging ratio of the liquid crystal capacitor may be improved so that the display quality may be improved.

The foregoing is illustrative of the described technology and is not to be construed as limiting thereof. Although a few exemplary embodiments of the described technology have been described, those skilled in the art will readily appreciate that many modifications are possible to the exemplary embodiments without materially departing from the novel teachings and advantages of the described technology. Accordingly, all such modifications are intended to be included within the scope of the described technology as defined in the appended claims. In the claims, means-plus-function clauses are intended to cover the structures described herein as performing the recited function and not only structural equivalents but also equivalent structures. Therefore, it is to be understood that the foregoing is illustrative of the described technology and is not to be construed as limited to the specific exemplary embodiments disclosed, and that modifications to the disclosed exemplary embodiments, as well as other exemplary embodiments, are intended to be included within the scope of the appended claims. The described technology is defined by the following claims, with equivalents of the claims to be included therein.

What is claimed is:

1. A method of driving a display panel comprising a plurality of pixels, each pixel connected to first and second gate lines, the method comprising:

applying a gate signal comprising a first voltage and a second voltage to the first gate line during a first predetermined period of equal or greater length than the period of two consecutive frames, wherein the gate signal is periodic for one frame and the second voltage is lower than the first voltage, applying a third voltage to the second gate line continuously throughout the first predetermined period of equal or greater length than the period of two consecutive frames, the third voltage which is a direct current (DC) voltage being different from the first and second voltages and lower than the second voltage;

applying the third voltage to the first gate line continuously throughout a second predetermined period of equal or greater length than the period of two consecutive frames, wherein the third voltage has a constant voltage level throughout each of the first and second predetermined periods; and applying the gate signal to the second gate line during the second predetermined period, wherein the pixel comprises a first transistor connected to the first gate line, a second transistor connected to the second gate line and a liquid crystal capacitor connected to the first and second transistors, and wherein each of the first and second transistors is directly connected to a same data line.

2. The method of claim 1, wherein the display panel further comprises a plurality of pixels each comprising a pixel electrode and first and second transistors, wherein one of the first and second transistors is configured to transfer a data signal to the pixel electrode based at least in part on the gate signal, and wherein the other transistor is configured to be turned off or become inactive based at least in part on the third voltage.

3. A method of driving a display panel comprising a plurality of pixels, each of the pixels comprising a pixel electrode of a liquid crystal capacitor, a first transistor connected to a first gate line and a pixel electrode, and a second transistor connected to the second gate line and the pixel electrode of the liquid crystal capacitor, the method comprising:

applying a gate signal comprising a first voltage and a second voltage to the first gate line in order to transfer a data signal to the pixel electrode through the first transistor during a first predetermined period of equal or greater length than the period of two consecutive frames, wherein the gate signal is periodic for one frame and the second voltage is lower than the first voltage;

applying a third voltage which is a direct current (DC) voltage and different from the first and second voltages to the second gate line continuously throughout the first predetermined period such that the second transistor turns into a non-operation mode during the first predetermined period, wherein the third voltage is lower than the second voltage;

applying the third voltage to the first gate line continuously throughout a second predetermined period of equal or greater length than the period of two consecutive frames such that the first transistor turns into a non-operation mode during the second predetermined period, wherein the third voltage has a constant voltage level throughout each of the first and second predetermined periods; and applying the gate signal to the second gate line in order to transfer the data signal to the pixel electrode through the second transistor during the second predetermined period, wherein each of the first and second transistors is directly connected to a same data line.

4. The method of claim 3, wherein the non-operation mode comprises a turn-off mode or an inactive mode.

5. The method of claim 3, wherein the second voltage is the maximum voltage of a range of voltages configured to turn off the first and second transistors and wherein the third voltage is the minimum voltage of the voltage range.

6. The method of claim 3, wherein each of the first and the first and second predetermined periods is one hour.

7. A display device, comprising:

a display panel comprising a plurality of pixels, and first and second gate lines, each of the pixels comprising i) a liquid crystal capacitor, ii) a first transistor connected to the first gate line and a pixel electrode of the liquid crystal capacitor, and iii) a second transistor connected to the second gate line and the pixel electrode;

a first gate driver configured to apply a gate signal comprising a first voltage and a second voltage being lower than the first voltage to the first gate line during a first predetermined period of equal or greater length than the period of two consecutive frames, and to apply a third voltage which is a direct current (DC) voltage and different from the first and second voltages and lower than the second voltage, to the first gate line continuously throughout a second predetermined period of equal or greater length than the period of two consecutive frames, wherein the third voltage has a constant voltage level throughout each of the first and second predetermined periods; and a second gate driver configured to apply the third voltage to the second gate line continuously throughout the first predetermined period, and to apply the gate signal to the second gate line during the second predetermined period, wherein each of the first and second transistors is directly connected to a same data line.

8. The display device of claim 7, wherein the first predetermined period is one hour.

9. The display device of claim 7, wherein each of the first and second predetermined periods is about one hour.

10. The display device of claim 7, wherein the second voltage is the maximum voltage of a range of voltages configured to turn off the first and second transistors and wherein the third voltage is the minimum voltage of the voltage range.

11. The display device of claim 7, wherein the display panel further comprises a plurality of gate lines comprising odd and even gate lines and wherein the gate signal is configured to be sequentially applied to the odd gate lines and wherein the third voltage is configured to be concurrently applied to the even gate lines during the first predetermined period.

12. The display device of claim 11, wherein the gate signal is configured to be sequentially applied to the even gate lines and wherein the third voltage is configured to be concurrently applied to the odd gate lines during the second predetermined period.

13. A display device, comprising:

a display panel comprising a plurality of pixels and a plurality of gate lines electrically connected to the pixels, wherein the gate lines are divided into even and odd gate lines;

a first gate driver configured to apply a gate signal comprising a first voltage and a second voltage being lower than the first voltage to the odd gate lines during a first predetermined period of equal or greater length than the period of two consecutive frames and- to apply a third voltage which is a direct current (DC) voltage and lower than the second voltage to the odd gate lines continuously throughout a second predetermined period of equal or greater length than the period of two consecutive frames, wherein the third voltage has a constant voltage level throughout each of the first and second predetermined periods; and a second gate driver configured to apply the third voltage to the even gate lines continuously throughout the first predetermined period and to apply the gate signal to the even gate line during the second predetermined period, wherein the pixel comprises a first transistor connected to the odd gate line, a second transistor connected to the even gate line and a liquid crystal capacitor connected to the first and second transistors, and wherein each of the first and second transistors is directly connected to a same data line.

14. The display device of claim 13, wherein each pixel comprises a pixel electrode, a first transistor electrically connected to one of the odd gate lines and the pixel electrode, and a second transistor electrically connected to one of the even gate lines and the pixel electrode.

15. The display device of claim 13, wherein the first and second predetermined periods are substantially equal.

* * * * *